US009275571B2

(12) United States Patent
Purdy et al.

(10) Patent No.: US 9,275,571 B2
(45) Date of Patent: Mar. 1, 2016

(54) METHOD AND SYSTEM TO QUICKLY FADE THE LUMINANCE OF AN OLED DISPLAY

(75) Inventors: Michael Lorne Purdy, Kitchener (CA); Bergen Albert Fletcher, Kitchener (CA); James Alexander Robinson, Elmira (CA)

(73) Assignee: BlackBerry Limited, Waterloo, Ontario (CA)

( * ) Notice: Subject to any disclaimer, the term of this patent is extended or adjusted under 35 U.S.C. 154(b) by 453 days.

(21) Appl. No.: 13/035,731

(22) Filed: Feb. 25, 2011

(65) Prior Publication Data

US 2012/0218314 A1 Aug. 30, 2012

(51) Int. Cl.
*G09G 3/32* (2006.01)

(52) U.S. Cl.
CPC ..... *G09G 3/3208* (2013.01); *G09G 2320/0276* (2013.01); *G09G 2320/064* (2013.01); *G09G 2320/0606* (2013.01); *G09G 2320/0633* (2013.01); *G09G 2320/0653* (2013.01); *G09G 2360/144* (2013.01)

(58) Field of Classification Search
CPC ..... G09G 2320/0653; G09G 2320/0626; G09G 2320/0276; G09G 3/3648
USPC ..... 345/690
See application file for complete search history.

(56) References Cited

U.S. PATENT DOCUMENTS

| | | | | |
|---|---|---|---|---|
| 7,477,248 | B2 | 1/2009 | Johnson | |
| 7,586,470 | B2 | 9/2009 | Chen | |
| 7,639,218 | B2 | 12/2009 | Lee et al. | |
| 2005/0023986 | A1 * | 2/2005 | Mizukoshi et al. | 315/169.3 |
| 2005/0093958 | A1 * | 5/2005 | Mori et al. | 347/207 |
| 2006/0284802 | A1 * | 12/2006 | Kohno | 345/76 |
| 2007/0222730 | A1 * | 9/2007 | Kao et al. | 345/89 |
| 2008/0179498 | A1 * | 7/2008 | Shimizu | 250/214 AL |
| 2008/0252628 | A1 * | 10/2008 | Han et al. | 345/207 |
| 2011/0074836 | A1 * | 3/2011 | Tang et al. | 345/690 |

FOREIGN PATENT DOCUMENTS

| | | | |
|---|---|---|---|
| EP | 1494202 | A1 | 1/2005 |
| EP | 1962267 | A1 | 8/2008 |
| EP | 1962267 | B1 | 12/2009 |

OTHER PUBLICATIONS

"SVGA+ Rev3 XL Series User's Specification, Revision 3", 852 x 600 Active Matrix OLED Microdisplay; eMagin, 48 pgs.
"European Application Serial No. 11156106.4, Response filed Oct. 21, 2011 to Search Report mailed Apr. 21, 2011", 13 pgs.
"European Application Serial No. 11156106.4, Extended European Search Report mailed Apr. 21, 2011", 7 pgs.
"Canadian Application Serial No. 2,769,377, Office Action mailed Jan. 13, 2014", 4 pgs.
"Canadian Application Serial No. 2,769,377, Response filed Jul. 11, 2014 to Office Action mailed Jan. 13, 2014", 28 pgs.
"Canadian Application Serial No. 2,769,377, Office Action mailed Jan. 20, 2015", 5 pgs.

* cited by examiner

*Primary Examiner* — Grant Sitta
*Assistant Examiner* — Mihir Rayan
(74) *Attorney, Agent, or Firm* — Thomas Grzesik; Fleit Gibbons Gutman Bongini & Bianco P.L.

(57) ABSTRACT

Various embodiments include devices, methods, circuits, data structures, and software that allow for rapid variation in the luminance of an OLED display panel. An OLED display driver circuit can include a first input, a second input, and a scaling circuit. The first input is to receive a scaling factor. The second input is to receive an image input signal including a digital representation of a desired output for a pixel. The scaling circuit is to multiply a pixel-level output voltage associated with the desired output for the pixel by the scaling factor.

26 Claims, 7 Drawing Sheets

METHOD AND SYSTEM TO QUICKLY FADE THE LUMINANCE OF AN OLED DISPLAY

BACKGROUND

Mobile devices are incorporating advanced display technology, such as liquid crystal light-emitting diode displays and organic light-emitting diode (OLED) based displays. As the capabilities of the display technology advances so too does the consumer's expectations in terms of functionality and esthetics associated with the display. Consumers demand high quality displays that are capable of fast response and vibrant display. One such capability commonly expected of a mobile device display is the ability to rapidly and smoothly fade or brighten the display in response to user input, programming, or external lighting conditions.

DETAILED DESCRIPTION

Figure 1:
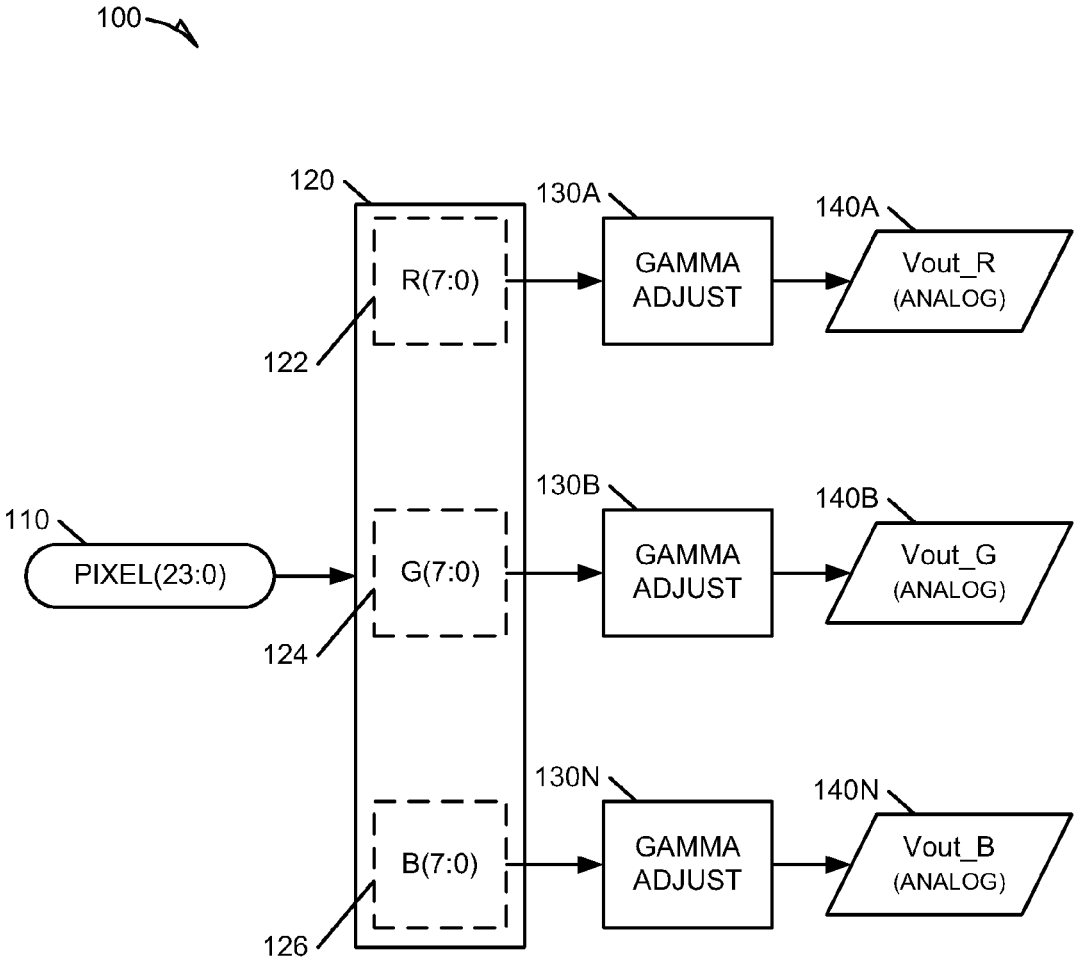
FIG. 1 is a block diagram illustrating a portion of an OLED driver circuit, according to an example embodiment.

In the following description, numerous specific details are set forth in order to provide a thorough understanding of example embodiments. It is to be understood, however, that the various embodiments may be practiced without these specific details. For example, logical, electrical and structural changes may be made without departing from the spirit and scope of the present subject matter. The following detailed description is, therefore, not to be taken in a limiting sense.

Methods and systems to quickly fade the luminance of an organic light-emitting diode (OLED) display panel are described. Embodiments described herein are directed to mobile device OLED display driver circuits that provide for efficient variable control over output brightness (luminance) through a single input. However, the concepts discussed herein are applicable to any OLED display (e.g., computer monitor, television). Mobile devices that utilize an OLED display can include cell phones, personal digital assistants (PDAs), smartphones, and tablet-style computers, among others. In an example, control over OLED luminance can be accomplished through the use of a scaling register associated with the gamma values programmed to control per pixel output within the OLED display. Gamma values refer to gamma correction used to code and decode luminance values in graphic display systems (e.g., video or still image electronic displays, such as a computer monitor or mobile device screen).

A mobile device can use a variety of display technologies, such as a liquid crystal display (LCD). Some mobile devices use an LCD-type display that includes a backlight or an active array of transistors (e.g., an active thin-film transistor matrix, or the like), or both, to control each pixel in the display. Backlit LCD displays can provide for fast response times and vibrant displays desired by today's mobile device consumer. Backlit LCD displays allow for rapid variations in display luminance simply by varying the output of the backlights. However, LCDs including a backlight or an active transistor matrix, or both, can have high power demands, thus shortening battery life of the mobile device.

OLED display technology is rapidly gaining ground versus LCDs for use in mobile devices due to the potential for improved power efficiency, improved color reproduction, and potential for thinner displays. Additionally, OLED displays can achieve faster response rates, achieve higher contrast levels, and produce higher saturated color reproduction. Unlike traditional LCD technology that requires a backlight to illuminate the display, OLED pixels are self-emissive (i.e. produce their own light). An OLED is an LED whose emissive electroluminescent layer can be composed of a thin-film of organic compounds capable of producing light when an electrical current is passed through it. OLEDs are capable of greater contrast ratios, thinner packaging, and deeper black levels, when compared to traditional LCD displays. However, fading or controlling the brightness of an OLED display can be more complicated than with LCD displays. As mentioned above, LCD displays are typically backlit; thus, varying the output level is a matter of varying the backlight.

Within a traditional LCD display, varying the output brightness can be accomplished by a backlight driver integrated circuit (IC). Typical driver ICs can use a pulse-width modulated (PWM) signal to vary the power delivered to the LEDs and thus vary the output brightness. Because OLEDs are self-emissive and depend upon programmed gamma values to map pixel input values to output voltages (e.g., to maintain color balance), current OLED driver ICs cannot effectively utilize a similar PWM signal to directly control brightness. Currently available driver ICs for OLEDs require reprogramming of the gamma values (e.g., reprogramming a look-up table mapping input values to output voltages) to change the brightness (luminance) of the OLEDs in a controlled manner. Reprogramming of the gamma values used for mapping digital input values to output voltages can require additional command traffic over a control interface, additional storage of pre-programmed gamma value mappings, or both.

FIG. 1 is a block diagram illustrating a portion of an OLED driver circuit, according to an example embodiment. In an example, a circuit 100 can include a pixel input 110, a splitter 120, gamma adjustment circuits 130A, 130B, 130N (collectively referred to as gamma adjustment circuits 130), and pixel-level voltage outputs 140A, 140B, and 140N (collectively referred to as pixel-level voltage outputs 140). In this example, the pixel input 110 can be a 24-bit value containing information to address an RGB (red, green, and blue) color space pixel. In another example, the pixel input 110 can be an 8-bit value containing information to address a grey-scale (0-254) pixel. In yet another example, the pixel input 110 can be a 32-bit (or greater) value containing information to address a CMYK (cyan, magenta, yellow, and key black) color space pixel.

In the example illustrated by FIG. 1, the splitter 120 can receive a 24-bit RGB color space pixel and divide the pixel input 110 into three individual 8-bit color values (e.g., 8-bit red value 122, 8-bit green value 124, and 8-bit blue value 126). In this example, the splitter 120 can pass the individual color components to associated gamma adjustment circuits 130. The gamma adjustment circuits 130 can map the individual color components into analog pixel-level voltage outputs 140. In some examples, the gamma adjustment circuits 130 can use look-up tables (LUTs) to map between input and output values. In other examples, the gamma adjustment circuits 130 can use circuit elements to transform input values into desired output values. The pixel-level voltage outputs 140 can be used to drive an individual pixel to emit light associated with the pixel input 110. In the example illustrated by FIG. 1, varying (or fading) the luminance of the OLED display requires reprogramming of the gamma adjustment circuits 130. Varying the luminance or intensity of light emitted by a display is often referred to as fading the display.

In an example embodiment, an OLED driver IC can be configured to accept a single scaling input that can be used to rapidly vary the brightness (luminance) output of an OLED display. The single scaling input can be either digital or analog (e.g., PMW signal). The OLED driver IC can use the scaling input to attenuate the gamma-adjusted voltage. For example, the scaling input can be applied to attenuate the gamma-adjusted voltage after the pixel input has been mapped by a gamma adjustment portion of the OLED driver IC. The use of a scaling input to enable rapid adjustment of the luminance of an OLED display is discussed further below in reference to FIGS. 2-6.

Figure 2:
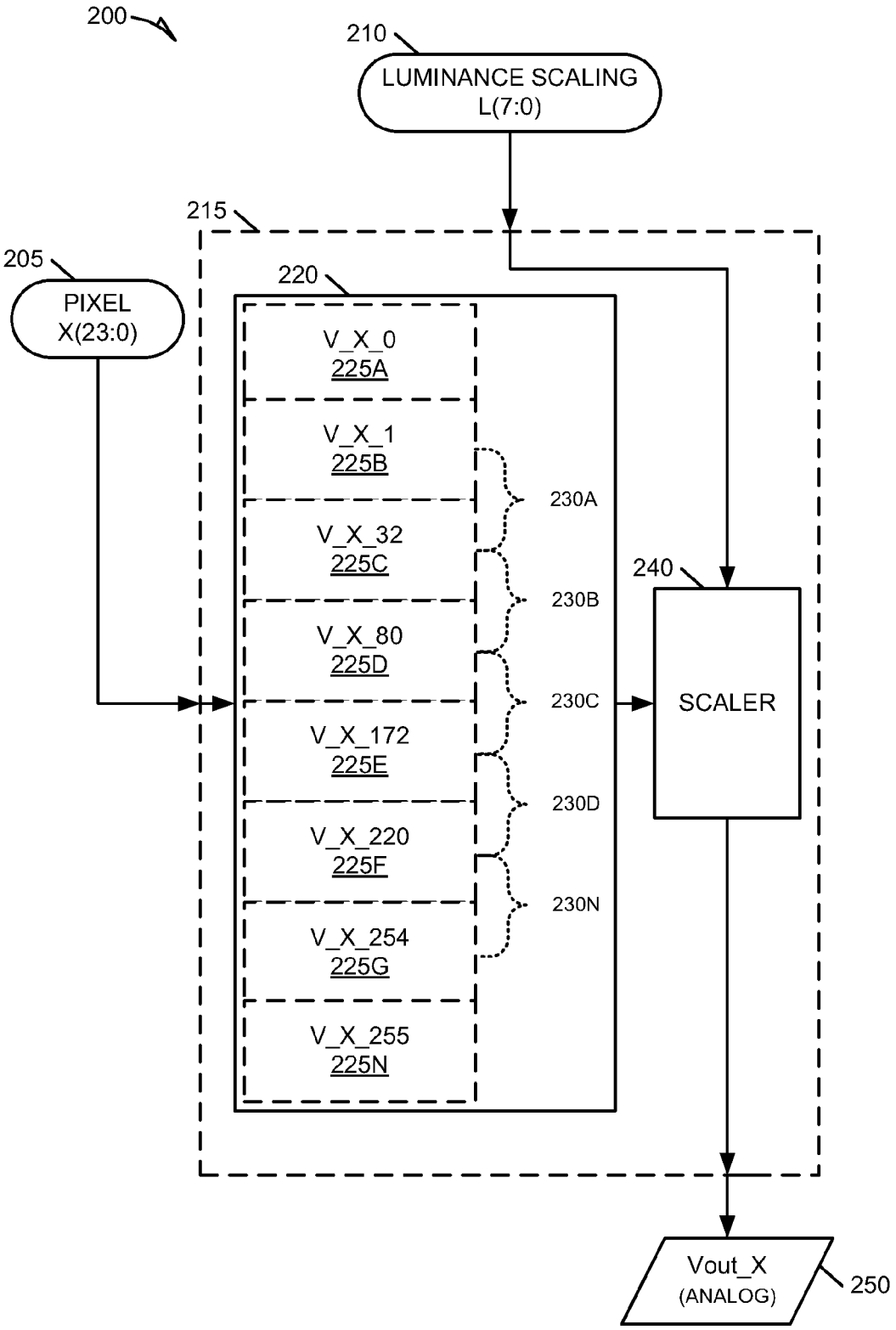
FIG. 2 is a block diagram of a section of an OLED driver IC, according to an example embodiment.

FIG. 2 is a block diagram of a section of an OLED driver IC, according to an example embodiment. In an example, a circuit 200 can include a pixel input 205, a luminance scaling input 210, a gamma block 220, a scaler circuit 240, and an output 250. In certain examples, the gamma block 220 and the scaler circuit 240 can be integrated into a voltage mapping circuit 215. In an example, the pixel input 205 can be a digital signal including eight (8) or more bits of data. In this example, the pixel input 205 is a 24-bit digital signal representing an RGB color space pixel value. In an example, the luminance scaling input 210 can be a digital or analog input that can be converted into a value between zero (0) and one (1) by the scaler circuit 240. In this example, the luminance scaling input is an 8-bit digital input. In another example, the luminance scaling input can be a PMW signal. In certain examples, the luminance scaling input 210 is programmable. In an example, the luminance scaling input 210 can be provided by a programmable processor, such as a processor within a mobile device. In this example, the programmable processor can vary the luminance scaling input 210 over a range that when converted is smaller than between zero (0) and one (1) (e.g., between 0.5 and 1). Varying the luminance scaling input 210 over a smaller range can result in quickly scaling the luminance uniformly across an OLED display above a threshold (i.e. minimum level of brightness). Other programmatic manipulation of the luminance scaling input 210 can produce various rapid uniform changes to the luminance across an OLED display. In some examples, the luminance scaling input is referred to as a scaling factor.

In an example, the circuit 200 includes a gamma block 220 that can be used to map pixel input 205 into a representative pixel-level analog voltage. The pixel-level analog voltage can be used to drive a pixel within an OLED display. In an example, the gamma block 220 contains a look-up table (LUT) with a fixed number of entities to map from a digital input signal to an analog output voltage level. In this example, the gamma block 220 contains a LUT with eight (8) voltage mappings (e.g., 225A-225N). In this example, the LUT is configured to directly map digital input values of 0, 1, 32, 80, 172, 220, 254, and 255 to corresponding pixel-level analog voltage values. In this example, the gamma block 220 can interpolate digital values that fall between the directly mapped values. Interpolation ranges are depicted within FIG. 2 by ranges 230A-230N. In an example, the gamma block 220 can use a linear interpolation to map the voltage of a value between directly mapped values. In another example, the gamma block 220 can simply round up or down to the nearest directly mapped value when interpolating inputs that fall between directly mapped values. In certain examples, the gamma block 220 can include a LUT with two-hundred and fifty five (255) directly mapped values, eliminating the need to interpolate for a given 8-bit input value.

In the example depicted by FIG. 2, the gamma block 220 outputs a mapped pixel-level voltage to a scaler circuit 240 (also referred to as a scaling circuit in some examples). In an example, the scaler circuit 240 can multiply the pixel-level voltage by the luminance scaling input 210 to reduce (fade) the pixel-level output voltage sent to the output 250. In an example, the luminance scaling input 210 can be interpreted by the scaler circuit 240 as a value between zero (0) and one (1). A value of one (1) will result in a full brightness (maximum luminance) output from the addressed pixel within the OLED display. A value of zero (0) can result in the addressed pixel being turned off (e.g., faded to zero luminance). Varying the luminance scaling input 210 between zero (0) and one (1) can result in the OLED display pixel varying between zero (0) output and full luminance.

In one example, the scaler circuit 240 can use the following equation to scale the output voltage:

$$Vout_X=(L/L_max)*Gamma_LUT[X(7:0)]$$

In the scaling equation, Vout_X represents the scaled pixel-level output voltage. L represents the luminance scaling input 210, L_max represents the maximum value that can be input for the luminance scaling input 210, and Gamma_LUT represents the mapped pixel-level voltage for a given pixel input, such as pixel input 205 (e.g., X(23:0), which is an 24-bit digital input in this example). This equation allows for the scaling input 210 to be interpreted as any value less than the maximum allowable scaling input. For example, L(7:0) is an 8-bit digital scaling input value that can vary between 0 and 254, with 254 being the maximum allowable scaling input (L_max).

Figure 3:
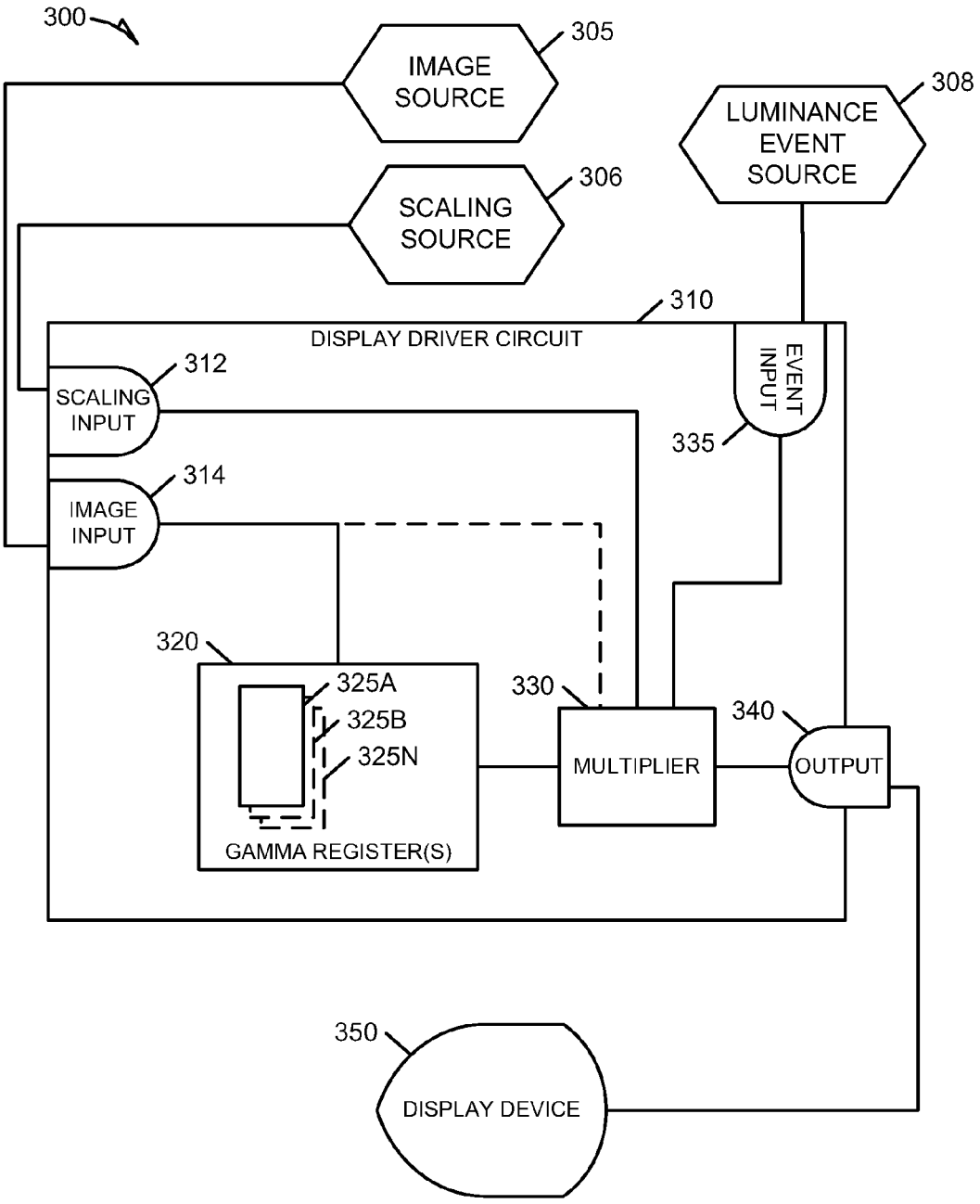
FIG. 3 is a block diagram illustrating a system for rapidly fading the luminance of an OLED display, according to an example embodiment.

FIG. 3 is a block diagram illustrating a system 300 for rapidly fading the luminance of an OLED display. In an example, the system 300 includes an image source 305, a scaling source 306, a luminance event source 308, a display driver circuit 310, and a display device 350. In one example, the display driver circuit 310 includes a scaling input 312, an image input 314, one or more gamma registers 320, a multiplier 330, an event input 335, and an output 340. In this example, the scaling input 312 can receive either a digital signal or a PWM analog signal from the scaling source 306. The scaling source 306 can include a general purpose processor or a dedicated ambient light control circuit. In certain examples, the general purpose processor can be programmed to provide scaling signals to the scaling input 312 in response to programmatic events. In some example, the general purpose processor can be programmed to provide scaling signals to the scaling input 312 in response to inputs received through a user interface displayed on the OLED display.

In the example depicted in FIG. 3, the image input 314 is coupled to the image source 305. The image source 305 can include dedicated or general purpose device memory accessed by a dedicated graphics processor or a general purpose device processor. In an example, the image source 305 can provide a stream of digital data addressed to individual pixels within the display device 350.

In an example, the gamma registers 320 can include one or more LUTs configured to map the digital pixel data received over the image input 314 into pixel-level voltages used to drive the individual pixels within the display device 350. In one example, the gamma registers 320 can include three LUTs (325A, 325B, and 325N), which can be used to map digital pixel data in an RGB color space (e.g., an 8-bit red value, an 8-bit green value, and an 8-bit blue value). In an example, the output of the gamma registers 320 can be operated on by the multiplier 330. The multiplier 330 can use the scaling input 312 to scale the output of the gamma registers 320 according to the desired luminance level (represented by the scaling input 312).

In an example, the display driver circuit 310 can be structured to by-pass the gamma registers 320 and pass the image source 305 data received by the image input 314 directly to the multiplier 330. In this example, the multiplier 330 can include circuitry structured to convert the image source 305 data into pixel-level voltages as well as scaling the pixel-level voltages according to the scaling input 312.

In certain examples, the multiplier 330 can be activated when a luminance event is received at the event input 335 from the luminance event source 308. The luminance event source 308 can include a general purpose processor or a user activated switch, among other structures. In an example, a general purpose processor can include programming that triggers luminance events in response to user input or other programming, such as a low battery power indication. In these examples, the multiplier 330 applies the scaling input 312 in response to receiving a luminance event from the event input 335.

Figure 4:
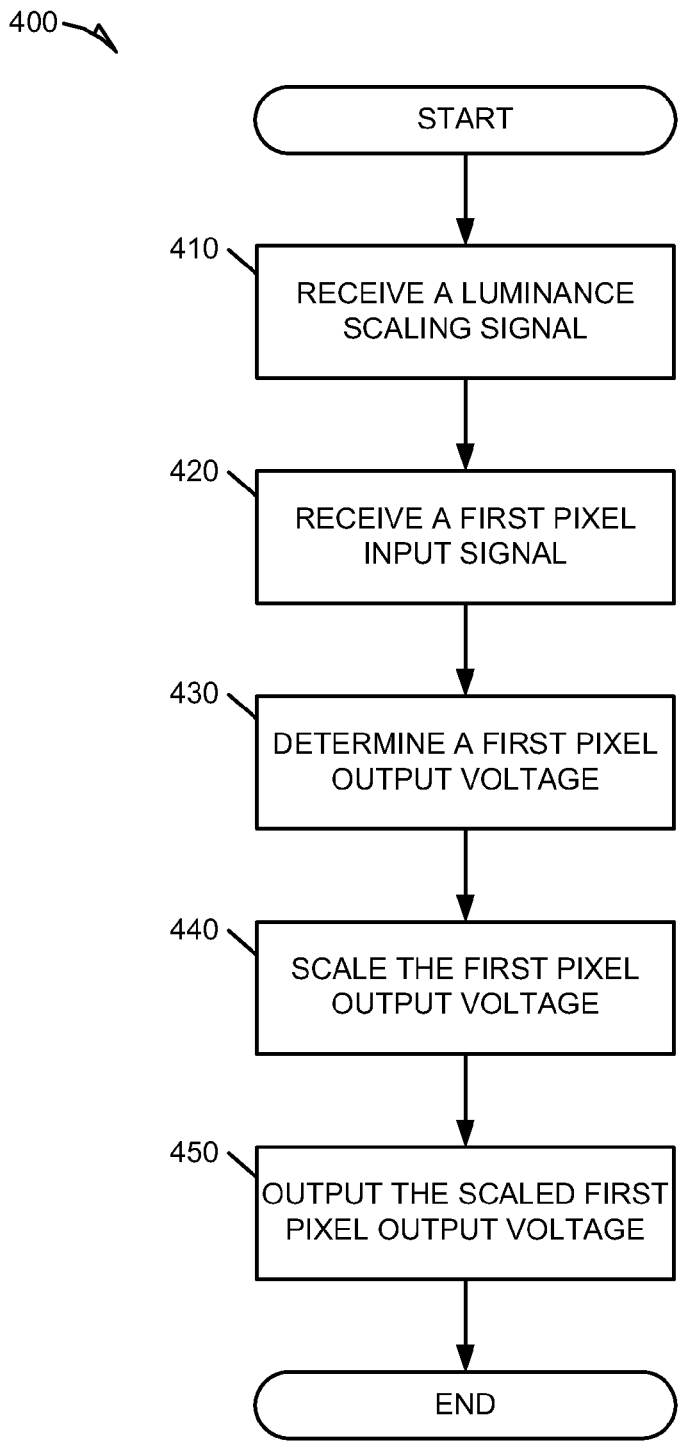
FIG. 4 is a flowchart illustrating an example method for varying the illumination output of an OLED display according to a luminance scaling signal, according to an example embodiment.

FIG. 4 is a flowchart illustrating an example method 400 for varying the illumination output of an OLED display according to a luminance scaling signal. In an example, the method 400 includes operations for receiving a luminance scaling signal (410), receiving a first pixel input signal (420), determining a first pixel output voltage (430), scaling the first pixel output voltage (440), and outputting the scaled first pixel output voltage (450). In one example, the method 400 can begin at operation 410, with respect to system 300 of FIG. 3, with the display driver circuit 310 receiving a luminance scaling signal on the scaling input 312. In certain examples, the scaling input 312 is configured to receive a digital input that can be used to scale the luminance of an OLED panel. In some examples, the scaling input 312 can be configured to receive a PWM signal that can be used by the display driver circuit 310 to vary the luminance of an OLED display.

At operation 420, the method 400 continues with the display driver circuit 310 receiving a first pixel input signal on the image input 314. At operation 430, the method 400 continues with the display driver circuit 310 determining a first pixel output voltage based on the first pixel input signal. In an example, the display driver circuit 310 communicates the first pixel input signal into the gamma registers 320, which can include one or more LUTs used to map the pixel input signal to an appropriate output voltage. At operation 440, the method 400 continues with the display driver circuit 310 scaling the first pixel output voltage. In an example, the display driver circuit 310 can use the multiplier 330 to scale the first pixel output voltage according to the luminance scaling signal received on the scaling input 312. At operation 450, the method 400 can conclude with the display driver circuit 310 outputting a scaled first pixel output voltage to the display device 350. In an example, the display driver circuit 310 can send the scaled first pixel output voltage to the display device 350 via an output 340.

Figure 5:
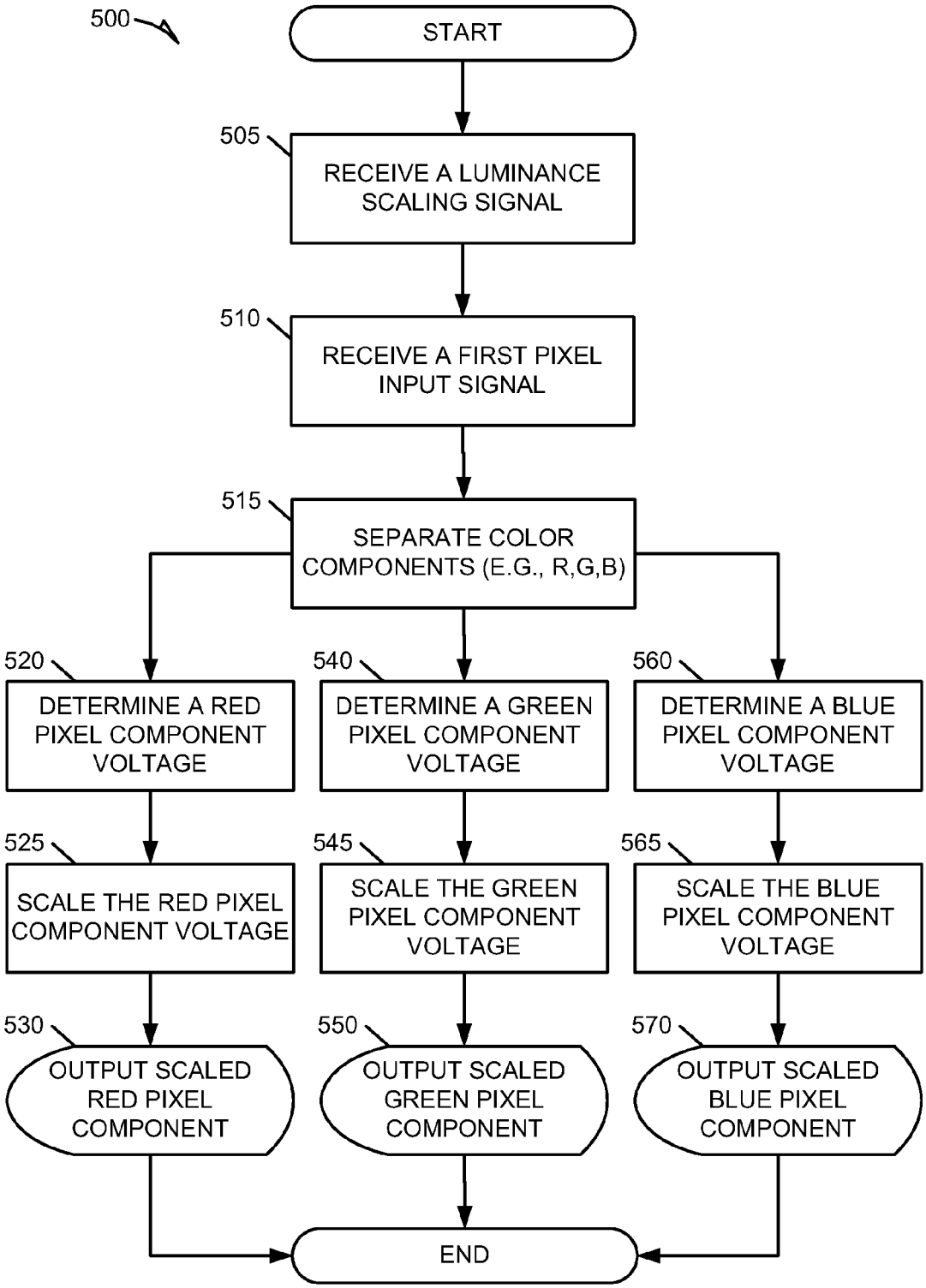
FIG. 5 is a flowchart illustrating an example method of varying the luminance of an OLED display, according to an example embodiment.

FIG. 5 is a flowchart illustrating an example method 500 of varying the luminance of an OLED display. As discussed above, an image source, such as image source 305, can consist of a stream of pixel values that include red, green, and blue components (or portions). In an example, the image source can provide a 24-bit value that contains three (3) 8-bit values representing red, blue, and green portions of each pixel. The method 500 provides an example of scaling individual color component output voltages (e.g., in an RGB color space, output of scaled red, green, and blue output voltages). In an example, the method 500 includes operations for receiving a luminance scaling signal (505), receiving a first pixel input signal (510), separating color components of the first pixel input signal (515), determining a red pixel component voltage (520), determining a green pixel component voltage (540), determining a blue pixel component voltage (560), scaling the red pixel component voltage (525), scaling the green pixel component voltage (545), scaling the blue pixel component voltage (565), outputting the scaled red pixel component voltage (530), outputting the scaled green pixel component voltage (550), and outputting the scaled blue pixel component voltage (570). Example method 500 can be described with respect to example system 300 of FIG. 3.

At operation 505, the method 500 begins with the display driver circuit 310 receiving a luminance scaling signal over the scaling input 312. At operation 510, the method 500 continues with the display driver circuit 310 receiving a first pixel input signal over the image input 314. In this example, the first pixel input signal is a 24-bit RGB color space pixel value that includes 8-bits of data for the red, green, and blue components of a single pixel. In some examples, the first pixel input signal can include a stream of pixel data that is processed by the display driver circuit 310 in a similar fashion.

At operation 515, the method 500 continues with the display driver circuit 310 separating the color components (e.g., red, green, and blue) for further processing. The remaining operations of the method 500 can be performed in parallel or sequentially depending upon the configuration of the display driver circuit 310 and associated hardware. In certain examples, the gamma registers 320 include individual registers associated with each color component (325A, 325B, 325N). In an example, the display driver circuit 310 can include multiple multipliers, such as multiplier 330, to assist in parallel processing of a signal color pixel input signal.

At operation 520, the method 500 continues with the display driver circuit 310 determining a red pixel component voltage. In an example, the display driver circuit 310 can use the gamma registers 320 to map the red component of the first pixel input signal to the red pixel component voltage. At operation 525, the method 500 continues with the display driver circuit 310 scaling the red pixel component voltage according to the luminance scaling signal. In an example, the display driver circuit 310 can use the multiplier 330 to scale the red pixel component voltage. At operation 530, the method 500 continues with the display driver circuit 310 outputting the scaled red pixel component voltage to a pixel on the display device 350.

Operations 540 through 570 of method 500 mirror operations 520-530 for the green and blue components of the first pixel input signal. The method 500 concludes by outputting three discrete voltage signals representing the red, green, and blue components of the first pixel input signal to the display device 350. In an example, the three voltage signals are sent to the display device 350 simultaneously.

Figure 6:
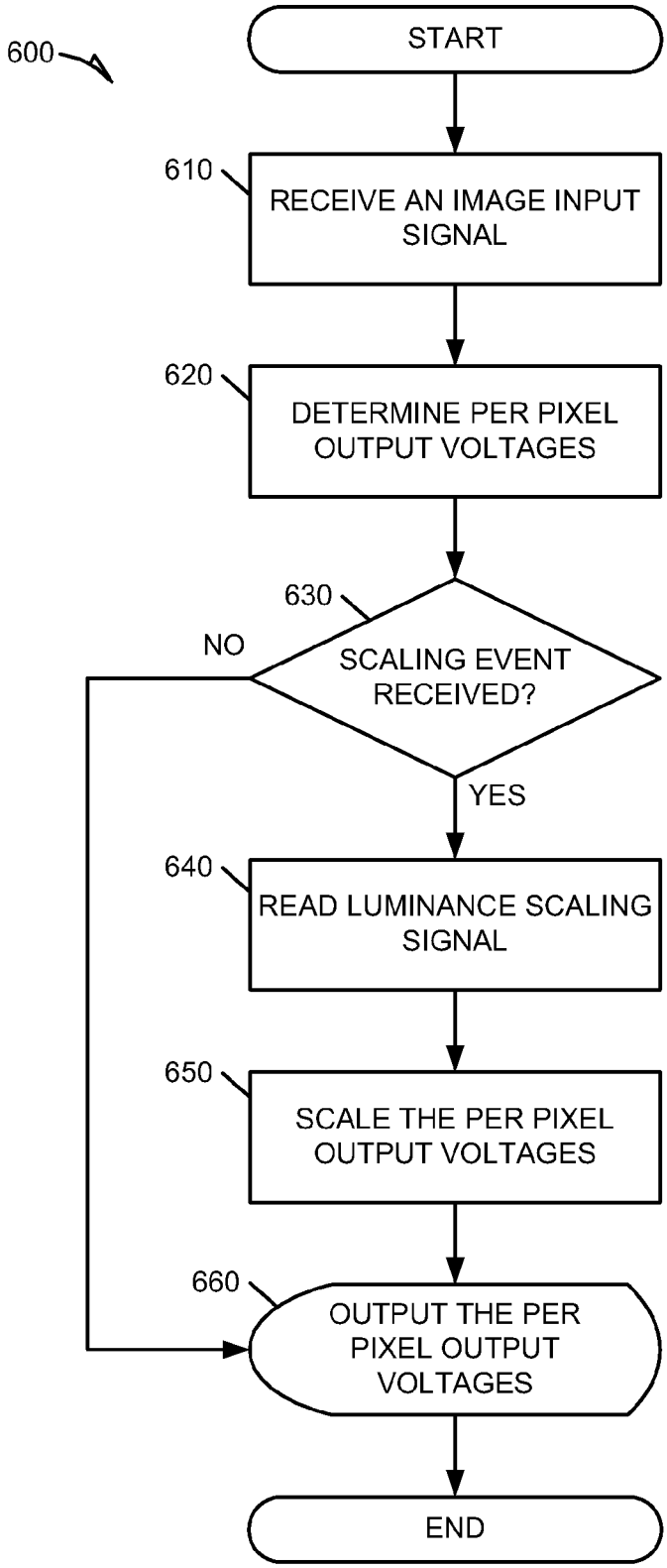
FIG. 6 is a flowchart illustrating an example method of varying the luminance of an OLED display based on receiving a triggering event, according to an example embodiment.

FIG. 6 is a flowchart illustrating an example method 600 of varying the luminance of an OLED display based on receiving a triggering event, according to an example embodiment. The method 600 includes operations for receiving an image input signal (610), determining per pixel output voltages for the image input signal (620), determining whether a scaling event has been received (630), reading a luminance scaling signal (640), scaling the per pixel output voltages (650), and outputting the per pixel output voltages (660). Example method 500 can be described with respect to example system 300 of FIG. 3.

The method 600 begins at operation 610 with the display driver circuit 310 receiving an image input signal over the image input 314. In an example, the image input signal is received from an image source 305. At operation 620 the method 600 continues with the display driver circuit 310 determining per pixel output voltages for the image input signal received by image input 314. In an example, the display driver circuit 310 can use the gamma registers 320 to map each pixel within the image input signal to an associated pixel output voltage. In certain examples, the image input signal can represent a still image to be displayed on the OLED display. In some examples, the image input signal can represent a dynamic image (e.g., video feed or graphical user-interface) sampled at a certain frequency, such as 60 Hz.

At operation 630, the method 600 continues with the display driver circuit 310 determining whether a scaling event has been received over event input 335. In an example, the scaling event can be used by the display driver circuit 310 to enable or disable scaling of the per pixel output voltages. Scaling of the per pixel output voltages can result in rapidly fading the luminance of the OLED display. If no scaling event has been received by the display driver circuit 310, the method 600 concludes at operation 660 with the display driver circuit 310 outputting the non-scaled per pixel output voltages over the output 340 to the display device 350.

If a scaling event has been received the method 600 continues at operation 640 with the display driver circuit 310 reading the luminance scaling signal received on the scaling input 312. At 650, the method 600 continues with the display driver circuit 310 using the scaling signal to scale the per pixel output voltages. In some examples, the scaling can be done incrementally over multiple scans of the image input signal to create a smooth effect on the OLED display. For example, when a scaling event is received the display driver circuit 310 can incrementally scale the per pixel output voltages over a certain number of scans of the 60 Hz input image signal, such as over 30 scans. This example would result in the luminance of the display fading smoothly over a half second period of time. At 660, the method 600 concludes with the display driver circuit outputting the scaled per pixel output voltages to the display device 350 via output 340.

Figure 7:
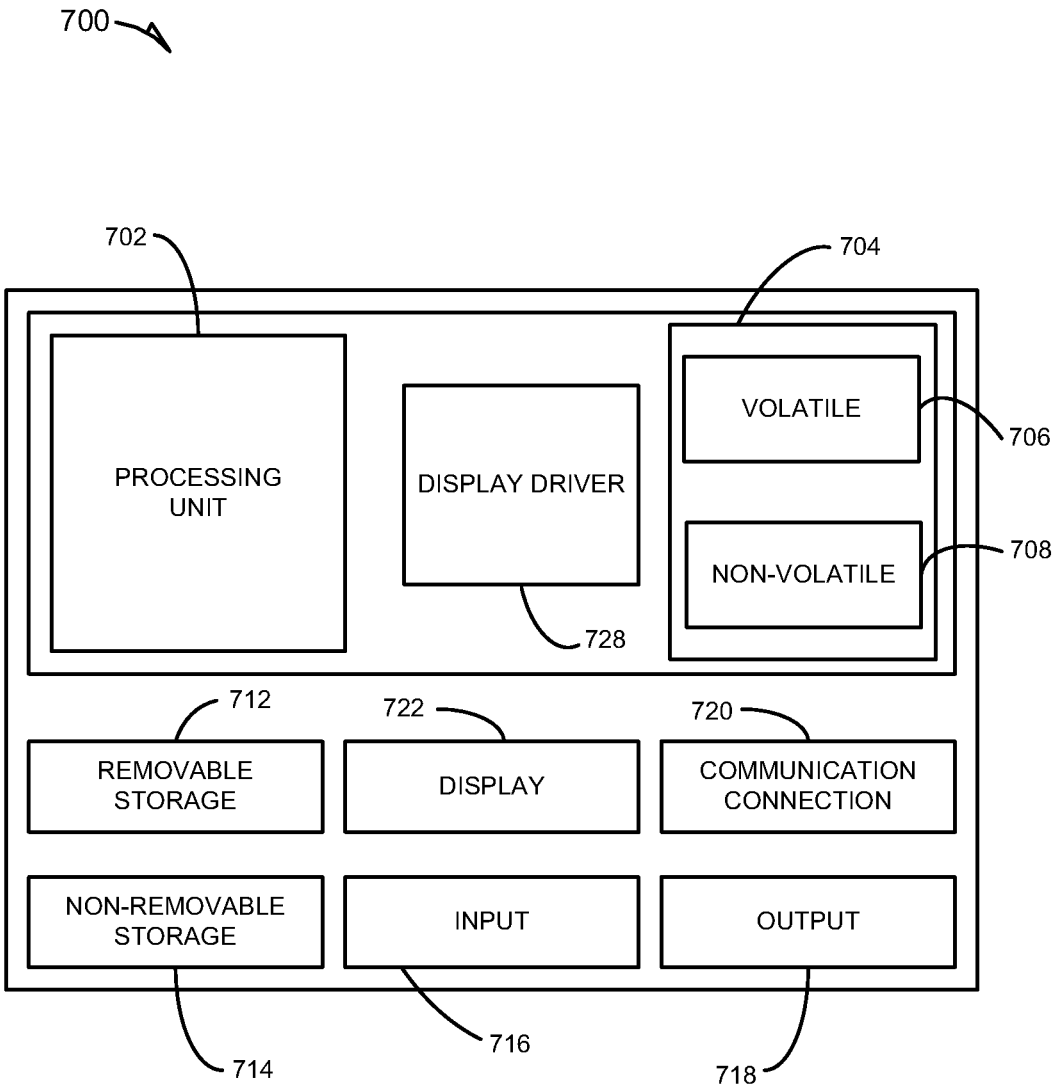
FIG. 7 is a block diagram depicting a mobile device, according to an example embodiment.

FIG. 7 is a block diagram depicting a mobile device 700 according to an example embodiment. In an example, the mobile device 700 includes a processing unit 702, memory 704, removable storage 712, non-removable storage 714, display 722, and display driver 728. The processing unit 702 may include one or more processing units or may include one or more multiple-core processing units. Memory 704 may include volatile memory 706 and non-volatile memory 708. Mobile device 700 may include a variety of device-readable media, such as volatile memory 706 and non-volatile memory 708, removable storage 712 and non-removable storage 714. The storage may include random access memory (RAM), read-only memory (ROM), erasable programmable read-only memory (EPROM) and electrically erasable programmable read-only memory (EEPROM), flash memory or other memory technologies, or any other medium capable of storing machine-readable instructions and data that may be present in a mobile electronic device. Mobile device 700 may include input 716, output 718, and a communication connection device 720.

The mobile device 700 typically operates in a networked environment using the communication connection device 720 to connect to one or more networks, such as a wireless telephone network. Through the communication connection device 720, the mobile device 700 may connect to one or more remote computers. The remote computer may include a personal computer (PC), server, router, network PC, a peer device, or other common network input, or the like. The communication connection device 720 may connect to various network types that may include a wireless telephone network, a Local Area Network (LAN), a Wide Area Network (WAN), the Internet, a proprietary subscription-based network, or other networks. The mobile device 700 also may include wireless telephone capabilities to provide voice telephone service via a wireless telephone network.

Machine-readable instructions stored on a machine-readable medium are executable by the processing unit 702 of the mobile device 700. The memory 704, removable storage 712, and non-removable storage 714 are examples of articles including a machine-readable medium. For example, a program with instructions that may be stored in memory 704 and when executed by the processing unit 702 can cause the mobile device 700 to perform one or more of the methods described herein. Other programs may also be stored on a machine-readable medium, such as a browser application providing web browsing functionality for the mobile device 700.

Method examples described herein can be machine or computer-implemented, at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer-readable instructions for performing various methods. The code may form portions of computer program products. Further, the code may be stored on one or more volatile or non-volatile computer-readable media during execution or at other times. These computer-readable media may include, but are not limited to, hard disks, removable magnetic disks, removable optical disks (e.g., compact disks and digital video disks), magnetic cassettes, memory cards or sticks, random access memories (RAMs), read-only memories (ROMs), and the like.

The above detailed description includes references to the accompanying drawings, which form a part of the detailed description. The drawings show, by way of illustration, specific embodiments in which the subject matter can be practiced. These embodiments are also referred to herein as "examples." Such examples can include elements in addition to those shown and described. However, the present inventors also contemplate examples in which only those elements shown and described are provided. It will be readily understood to those skilled in the art that various other changes in the details, material, and arrangements of the parts and method stages which have been described and illustrated herein may be made without departing from the principles of the inventive subject matter.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more features thereof) may be used in combination with each other. Other embodiments can be used, such as by one of ordinary skill in the art upon studying the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment.

What is claimed is:

1. An organic light emitting diode (OLED) display driver circuit comprising:

gamma circuitry;

a first input to receive a luminance scaling factor per pixel from a scaling source, the luminance scaling factor per pixel separate from gamma values and gamma correction, the luminance scaling factor per pixel having a value within a range of values for the luminance scaling factor per pixel, the scaling source being independent from the gamma circuitry;

a second input to receive an image input signal, the image input signal including a digital representation of a desired output for pixels within an OLED display; and a luminance scaling circuit to receive a pixel-level analog output voltage for each pixel and multiply the pixel-level analog output voltage for each pixel, corresponding to the image input signal, by the respective luminance scaling factor of each pixel, the luminance scaling circuit operable to change luminance across the OLED display, independent of gamma adjustment by use of the luminance scaling factor independent of the image input signal.

2. The OLED display driver circuit of claim 1, wherein the first input is structured to receive a signal representing a value between 1 and 0.

3. The OLED display driver circuit of claim 1, wherein the first input is structured to receive a pulse-width modulated signal representing a value between 1 and 0.

4. The OLED display driver circuit of claim 1, wherein the second input is structured to receive a signal representing a gray-scale pixel value.

5. The OLED display driver circuit of claim 1, further including a register coupled to the second input and containing a look-up table, the look-up table configured to map the digital representation of a desired output for each pixel to a pixel-level analog output voltage.

6. The OLED display driver circuit of claim 5, wherein the second input is structured to receive an image input signal representing a color pixel value for each pixel, the image input signal including a first component representing red, a second component representing green, and a third component representing blue for each pixel.

7. The OLED display driver circuit of claim 6, wherein the register contains a look-up table associated with each of the first component, the second component, and the third component of the image input signal representing the color pixel value for each pixel.

8. The OLED display driver circuit of claim 5, wherein the register is structured to map for each pixel:

an 8-bit value representing a red portion of the digital representation of the desired output for the respective pixel to a first pixel-level analog output voltage;

an 8-bit value representing a green portion of the digital representation of the desired output for the respective pixel to a second pixel-level analog output voltage; and an 8-bit value representing a blue portion of the digital representation of the desired output for the respective pixel to a third pixel-level analog output voltage.

9. The OLED display driver circuit of claim 8, wherein the luminance scaling circuit is to scale the first, second, and third pixel-level analog output voltages using the luminance scaling factor for the respective pixel.

10. A method comprising:

receiving an input signal, the input signal including a digital representation of a desired output for pixels within a display device;

receiving, in a display drive circuit having gamma circuitry, a luminance scaling signal from a scaling source, the luminance scaling signal including a luminance scaling factor per pixel, the luminance scaling factor per pixel having a value within a range of values for the luminance scaling factor per pixel, the luminance scaling factor per pixel separate from gamma values and gamma correction and independent of the input signal, the scaling source being independent from the gamma circuitry;

determining a pixel analog output voltage for each of the pixels from the input signal;

scaling the pixel analog output voltage for each of the pixels, by a luminance scaling circuit separate from the scaling source, by the respective luminance scaling factor of each pixel to produce a scaled pixel analog output voltage, the scaling comprising multiplying the pixel analog output voltage by the respective luminance scaling factor divided by a maximum value in the range of values;

conducting, when the gamma circuitry is by-passed, the scaling independent of gamma adjustment to scale luminance across the display device using the luminance scaling factor independent of the image input signal; and outputting the scaled pixel output voltage such that changes to the luminance across the display device are generated.

11. The method of claim 10, wherein the determining the pixel output voltage for each of the pixels from the input signal includes using a look-up table, the look-up table including gamma values that map digital input signals to pixel-level analog output voltages for each of the pixels.

12. The method of claim 10, wherein receiving the luminance scaling signal includes receiving a signal representing a value between 0 and 1.

13. The method of claim 10, wherein receiving the luminance scaling signal includes receiving a pulse-width modulated signal representing a value between 0 and 1.

14. The method of claim 10, wherein receiving the input signal includes receiving a signal representing a gray-scale pixel value.

15. The method of claim 10, wherein receiving the input signal includes receiving an image input signal representing a color pixel value, the image input signal including a first component addressing a red portion of a pixel, a second component addressing a green portion of the pixel, and a third component addressing a blue portion of the pixel.

16. The method of claim 15, wherein the determining the pixel output voltage of the pixel includes using a series of look-up tables, each look-up table including gamma values that map one of the first component, the second component, and the third component addressing the red portion, the green portion, or the blue portion of the input signal to pixel-level analog output voltage of the pixel.

17. The method of claim 15, wherein determining the pixel output voltage of the pixel includes determining a first pixel output voltage using the first component addressing the red portion of the pixel, a second pixel output voltage using the second component addressing the green portion of the pixel, and a third pixel output voltage using the third component addressing the blue portion of the pixel.

18. The method of claim 17, wherein scaling the pixel output voltage of the pixel includes scaling the first, second, and third output voltages using the respective luminance scaling factor of the pixel.

19. An apparatus comprising:

a processor coupled to a memory circuit;

an organic light emitting diode (OLED) display including a plurality of individually addressable pixels;

an OLED display driver circuit coupled to the OLED display, the OLED display driver circuit including:

gamma circuitry;

a first input to receive a luminance scaling factor per pixel from the processor, the luminance scaling factor per pixel separate from gamma values and gamma correction, the luminance scaling factor per pixel having a value within a range of values for the luminance scaling factor per pixel, the processor being independent from the gamma circuitry;

a second input to receive an image input signal from the processor, the image input signal including image data to drive the plurality of individually addressable pixels; and a luminance scaler circuit coupled to the first input and the second input, the luminance scaler circuit structured to receive pixel-level analog output voltages associated with the plurality of individually addressable pixels in the image input signal and multiple the pixel-level output voltages by the respective luminance scaling factor of each pixel, the luminance scaler circuit operable to change luminance across the OLED display, independent of gamma adjustment by use of the luminance scaling factor independent of the image input signal.

20. The apparatus of claim 19, further including a register coupled between the second input and the scaler circuit, the register including a look-up table and an output input, the look-up table configured to map data representing each of the plurality of individual addressable pixels within the image input signal to the pixel-level analog output voltages.

21. The apparatus of claim 19, wherein the OLED display driver circuit is to receive, at the first input, a luminance scaling factor that can be converted into a scaling value between 0 and 1.

22. The apparatus of claim 19, wherein the OLED display driver circuit is to receive at the first input a pulse-width modulated signal representing a value between 0 and 1.

23. The apparatus of claim 19, wherein the OLED display driver circuit is to receive, at the second input, an image input signal including a value associated with each of the plurality of individually addressable pixels of the OLED display.

24. The OLED display driver circuit of claim 1, wherein the luminance scaling factor per pixel is a single luminance scaling factor for all pixels.

25. The OLED display driver circuit of claim 1, wherein the OLED display driver circuit includes a third input operatively coupled to the luminance scaling circuit, the third input arranged to receive a luminance event signal to trigger the luminance scaling circuit to multiply the pixel-level analog output voltage by the respective luminance scaling factor for each pixel.

26. The method of claim 10, wherein scaling the pixel output voltage for each of the pixels is initiated based on receiving a luminance event signal to trigger the scaling of the pixel output voltage for each of the pixels using the respective luminance scaling factor of each pixel.

* * * * *